US006299144B1

(12) United States Patent
Salvisberg

(10) Patent No.: US 6,299,144 B1
(45) Date of Patent: Oct. 9, 2001

(54) CARBURETOR DEVICE WITH ADDITIONAL AIR-FUEL FLOW APERTURES

(76) Inventor: Marc W. Salvisberg, 855 San Anselmo Ave., San Anselmo, CA (US) 94901

( * ) Notice: Subject to any disclaimer, the term of this patent is extended or adjusted under 35 U.S.C. 154(b) by 0 days.

(21) Appl. No.: 09/519,787

(22) Filed: Mar. 7, 2000

(51) Int. Cl.[7] ..... F02M 7/133; F02M 29/04

(52) U.S. Cl. ..... 261/40; 261/DIG. 21; 261/DIG. 55

(58) Field of Search ..... 261/35, 40, 69.1, 261/65, 50.1, DIG. 21, DIG. 38, DIG. 39, DIG. 55, DIG. 83

(56) References Cited

U.S. PATENT DOCUMENTS

| | | | | |
|---|---|---|---|---|
| Re. 14,780 | * | 12/1919 | Ball | 261/DIG. 21 |
| 1,201,976 | * | 10/1916 | Lovejoy | 261/DIG. 55 |
| 1,270,486 | * | 6/1918 | Brown | 261/DIG. 21 |
| 1,306,031 | * | 6/1919 | Stiger | 261/DIG. 21 |
| 1,706,557 | * | 3/1929 | Baumgardner et al. | 261/DIG. 55 |
| 3,852,391 | * | 12/1974 | Hisatomi et al. | 261/DIG. 21 |
| 3,867,487 | * | 2/1975 | Matsumoto | 261/DIG. 55 |
| 4,016,845 | * | 4/1977 | Marsee | 261/DIG. 55 |
| 4,044,080 | * | 8/1977 | Matsumoto et al. | 261/DIG. 55 |
| 4,399,079 | * | 8/1983 | Lowe | 261/DIG. 83 |
| 4,517,134 | * | 5/1985 | Nakamura et al. | 261/69.1 X |
| 4,765,932 | * | 8/1988 | Muraji | 261/69.1 X |
| 5,300,259 | * | 4/1994 | Tashiro | 261/DIG. 39 |
| 5,472,645 | * | 12/1995 | Rock et al. | 261/DIG. 21 |
| 5,716,555 | * | 2/1998 | Mullican et al. | 261/50.1 X |
| 5,720,906 | * | 2/1998 | Yamanaka et al. | 261/35 |
| 5,827,335 | * | 10/1998 | Ward | 261/65 X |
| 6,142,454 | * | 11/2000 | Aronsson et al. | 261/35 |

* cited by examiner

*Primary Examiner*—Richard L. Chiesa
(74) *Attorney, Agent, or Firm*—Cherskov & Flaynik

(57) ABSTRACT

A carburetor device (10) having a plurality of apertures (12) circumferentially positioned and equally spaced around an orifice (14) portion of the carburetor device (10). The apertures (12) have a cross sectional area dimensioned to allow an air-fuel mixture to flow therethrough when a throttle member requires maximum power and corresponding air-fuel flow rates. The apertures (12) direct the air-fuel flow (30) through a "puddle" (27) of fuel that has accumulated in the bottom portion (28) of an outer well (18) of the carburetor (10) during the normal operation of an internal combustion engine. When maximum power is required from the engine, the increased air-fuel flow through the apertures (12) causes the fuel puddle (27) to vaporize or "mist", allowing the fuel to become a part of the air-fuel flow stream supplying the engine's cylinders (25) thereby increasing the engine's power and response while decreasing the engine's hydrocarbon emissions.

14 Claims, 7 Drawing Sheets

CARBURETOR DEVICE WITH ADDITIONAL AIR-FUEL FLOW APERTURES

BACKGROUND OF THE INVENTION

1. Field of the Invention

The present invention relates generally to carburetors and, more particularly, to carburetors having additional apertures positioned adjacent to an internal orifice that delivers an air-fuel flow mixture to an internal combustion engine.

2. Background of the Prior Art

A carburetor is the primary component for supplying an air-fuel mixture to an internal combustion engine. The function of carburetors is to combine or mix fuel with an air flow created by the vacuum pressure generated from the pistons of the internal combustion engine. The advantage of using a carburetor is that a relatively simple and inexpensive device can supply an air-fuel mixture capable of satisfying a relatively wide range of power demands and acceleration modes.

A disadvantage of prior art carburetors is the depositing of liquid fuel upon the side walls of a well portion of the carburetor. The liquid fuel deposits can occur due to a myriad of causes including temperature differentials, friction and pressure changes. The liquid fuel deposits, due to gravity, eventually accumulate in a bottom portion of the well around a needle element inserted into an orifice that supplies the air-fuel mixture. The needle element is connected to a speed control throttle that controls air flow in the carburetor. Speed control throttles include movable slide valves and butterfly valves. The accumulated liquid fuel does not effect the performance of the internal combustion engine so long as maximum air-fuel flow rates are not demanded by the control throttle. However, should a richer air-fuel flow rate be required quickly during acceleration when a liquid fuel accumulation or "puddle" is present, during cruise mode for example, the internal combustion engine's performance will decrease and unburnt hydrocarbons discharged to atmosphere will increase. The reduced engine performance and increased emissions are the result of large liquid fuel portions or "droplets" being lifted relatively slowly from the puddle by the quick increase to a maximum air-fuel flow rate and dumped, still in liquid droplet form, into the piston cylinder.

Many carburetor designs and systems are available, (see U.S. Pat. Nos. 5,827,335; 5,716,555; 4,399,079 and 4,016,845). None provide a device that is capable of causing the liquid fuel puddle surrounding the needle element to mix with a flowing air-fuel stream when a control throttle requires a fast increase to a maximum air-fuel flow rate thereby decreasing hydrocarbon emissions and increasing engine response.

SUMMARY OF THE INVENTION

It is an object of the present invention to provide a carburetor device that overcomes many of the disadvantages of the prior art.

A principle object of the present invention is to provide a carburetor device that mixes accumulated liquid fuel in a well portion of the device with a flowing air-fuel stream. A feature of the device is a plurality of apertures positioned adjacent to an orifice that connects the well portion to a cavity in the device. An advantage of the device is reduced unburnt hydrocarbons emissions and increased response and power from an internal combustion engine.

Still another object of the present invention is to prevent the accumulated liquid fuel from flowing down the plurality of apertures into the cavity of the device. A feature of the device is the relatively small cross-sectional area of each of the apertures. An advantage of the device is that the accumulated liquid fuel remains in the well until a maximum air-fuel flow rate and a corresponding increase in engine power are required.

Yet another object of the present invention is to prevent air-fuel flow through the plurality of apertures when liquid fuel has accumulated in a bottom portion of the well of the device. A feature of the device is the relative close positioning of the plurality of apertures in relation to the orifice connecting the well portion to the cavity in the device. An advantage of the device is that the accumulated liquid fuel does not evaporate or "mist" until a maximum air-fuel flow rate and a corresponding increase in engine power are required.

Briefly, the invention provides an improved carburetor device for an internal combustion engine, said improvement comprising a plurality of apertures circumferentially disposed in relation to an orifice joining an inner mixing cavity to an outer well member, the orifice having an air flow control member inserted therein, said apertures extending from the inner mixing cavity to the outer well member; means for preventing liquid fuel from draining into said apertures; means for urging air flow through said apertures; and means for engaging said liquid fuel with said air flow through said apertures thereby vaporizing said liquid fuel and correspondingly increasing power output and decreasing unburned hydrocarbon emissions from the internal combustion engine.

BRIEF DESCRIPTION OF THE DRAWINGS

The foregoing invention and its advantages may be readily appreciated from the following detailed description of the preferred embodiment, when read in conjunction with the accompanying drawings in which.

DETAILED DESCRIPTION OF THE PREFERRED EMBODIMENT

Figure 1:
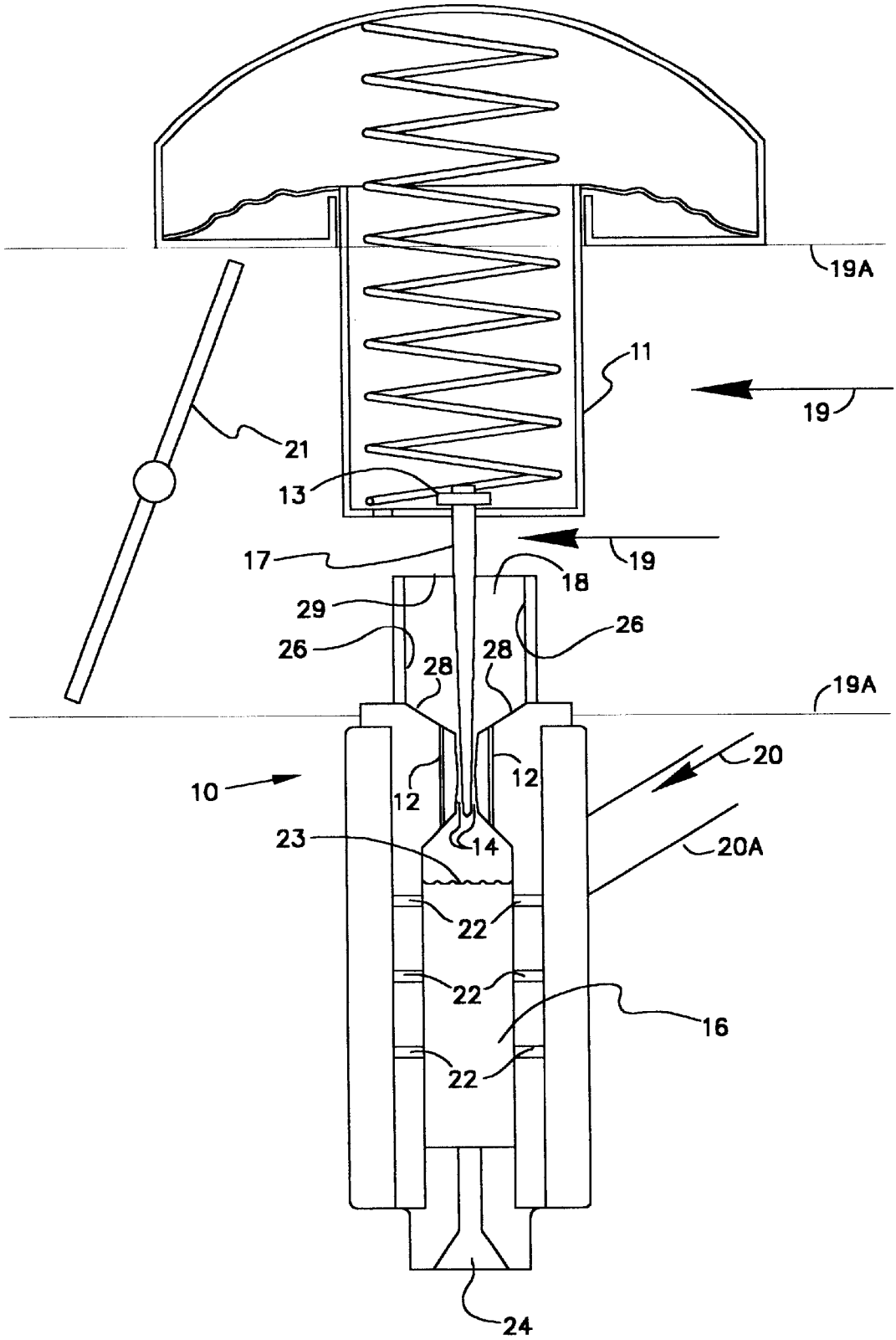
FIG. 1 is a front sectional view of a carburetor at low power demand in accordance with the present invention.
Figure 2:
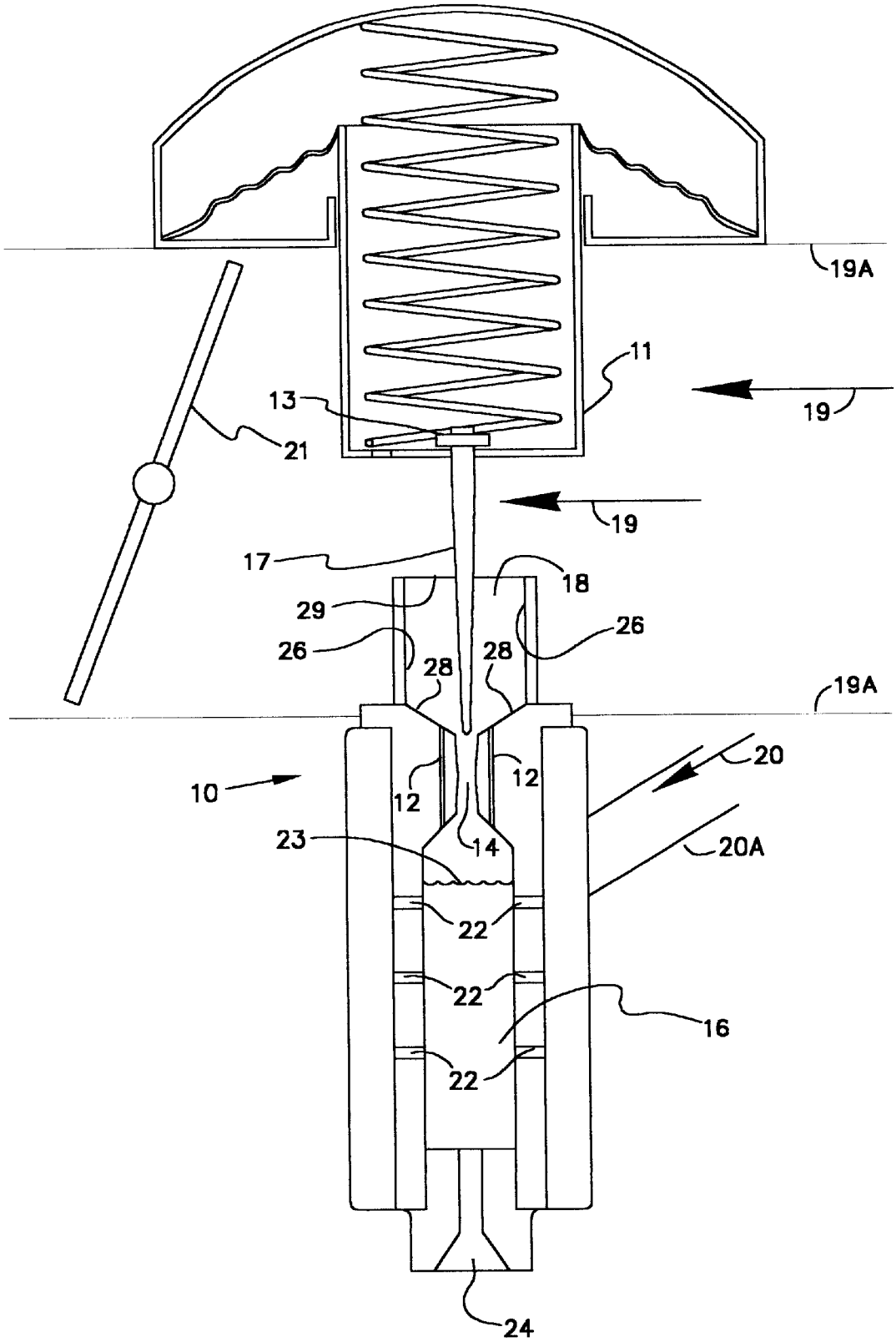
FIG. 2 is a front sectional view of the carburetor of FIG. 1 at high power demand in accordance with the present invention.
Figure 3:
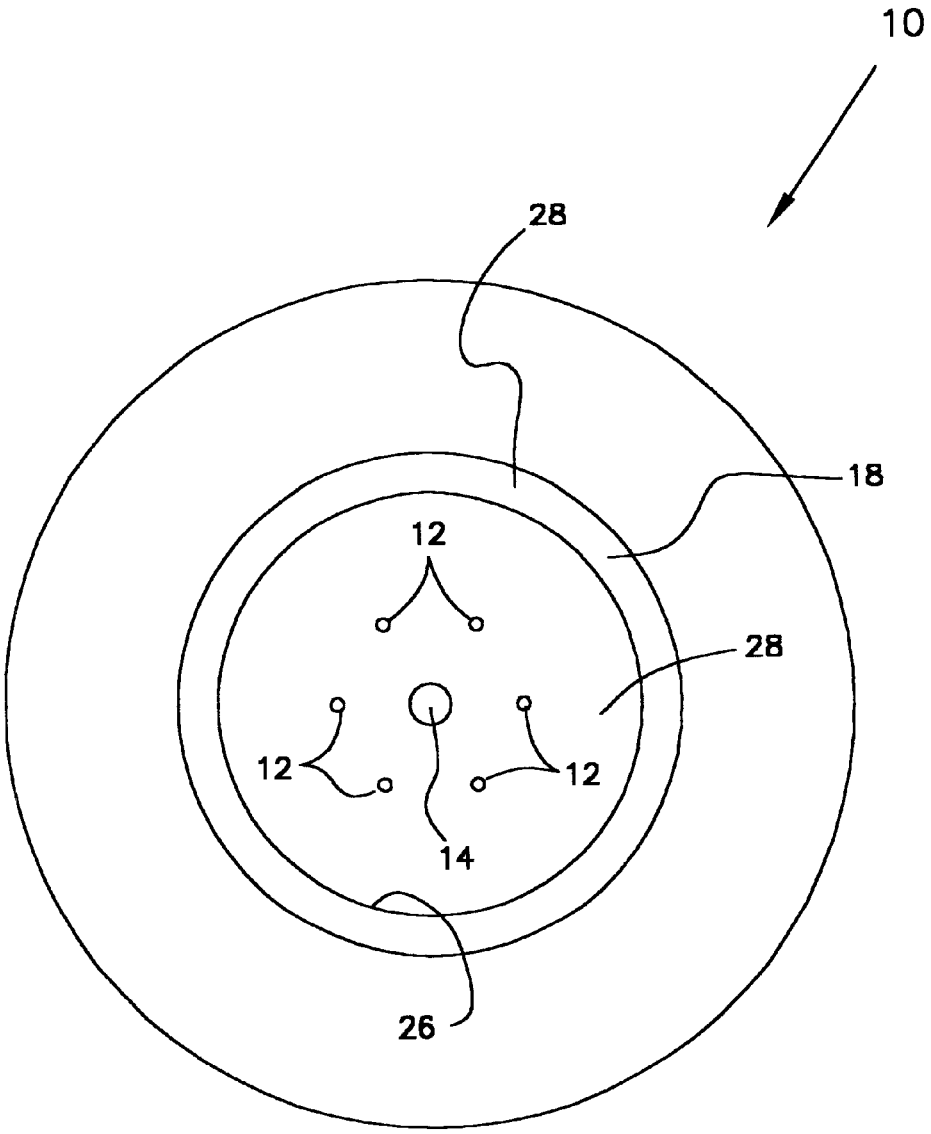
FIG. 3 is a top elevation view of a carburetor in accordance with the present invention.

Referring now to the drawings and in particular to FIGS. 1–3, an improved motorcycle carburetor is denoted by numeral 10. The improvement includes a plurality of apertures 12 circunferentially positioned around an orifice 14 joining an inner fuel-air mixing chamber or cavity 16 to an outer receptacle well member 18. The carburetor includes a tapered needle element 17 inside the orifice with the needle being connected to the engines accelerator (not shown) via a diaphragm-spring assembly 11, an assembly well known to those of ordinary skill in the art. The needle element 17 is secured to the diaphragm-spring assembly 11 by a clip 13 that is attached to an inner portion of the assembly 11.

The apertures 12 are formed when die casting a new carburetor or by boring the apertures into a prior art carburetor, or by replacing part of a prior art carburetor to include apertures therein. The boring of the apertures 12 is accomplished by utilizing one of several options available in the art including drilling and cutting with a laser.

The theory of operation of a carburetor for an internal combustion engine is well known to one of ordinary skill in the art; however, a brief review is required to better explain the improvement and how the improvement functions in relation to a prior art carburetor. Referring to FIGS. 1–4, main air flow 19 is urged through an air passageway 19A by a vacuum created by the pistons cycling inside the internal combustion engine. The main air flow 19 is controlled by a throttle valve 21 that is adjusted by the accelerator which is positioned by an individual operating the engine. As more engine power is required, the accelerator opens the throttle valve 21, and lifts the needle 17 from the orifice 14 to allow an air-fuel mixture flow from the cavity 16 into the main air flow 19 in the main air passageway 19A. The air-fuel mixture flow is the result of air flow 20 urged into air passageway 20A due to the main air flow 19 over the open top 29 of receptacle well 18 ( a venturi effect) to engine cylinders 25. The air flow 20 into air passageway 20A continues into the mixing cavity 16 via ports 22; whereupon, the air flow combines with liquid fuel 23 supplied from a fuel port 24, then exists the mixing cavity 16 via the orifice 14 as an air-fuel mixture with a predetermined air-fuel ratio.

Figure 4:
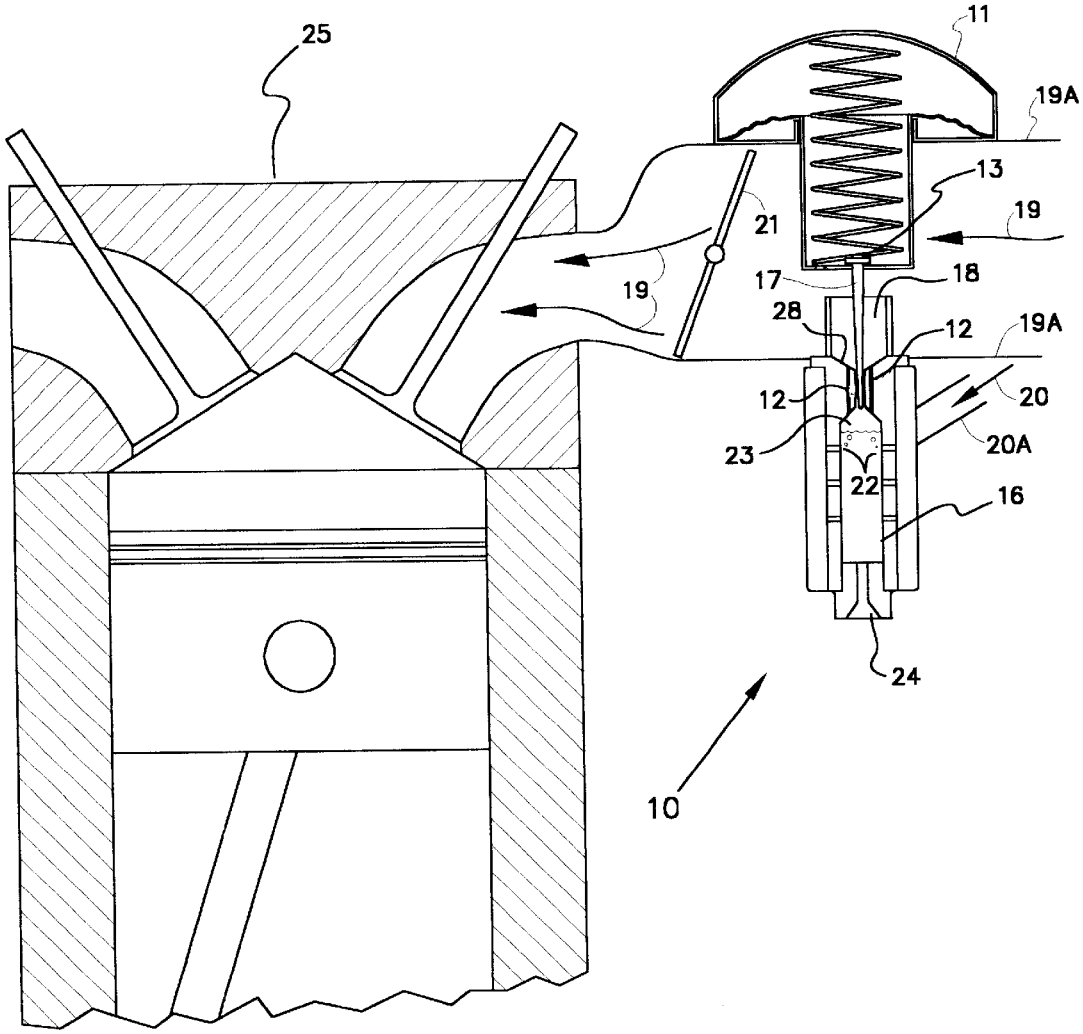
FIG. 4 is a front sectional view of the carburetor of FIG. 1 that supplies an explosive air-fuel flow mixture to a cylinder of an internal combustion engine.
Figure 5:
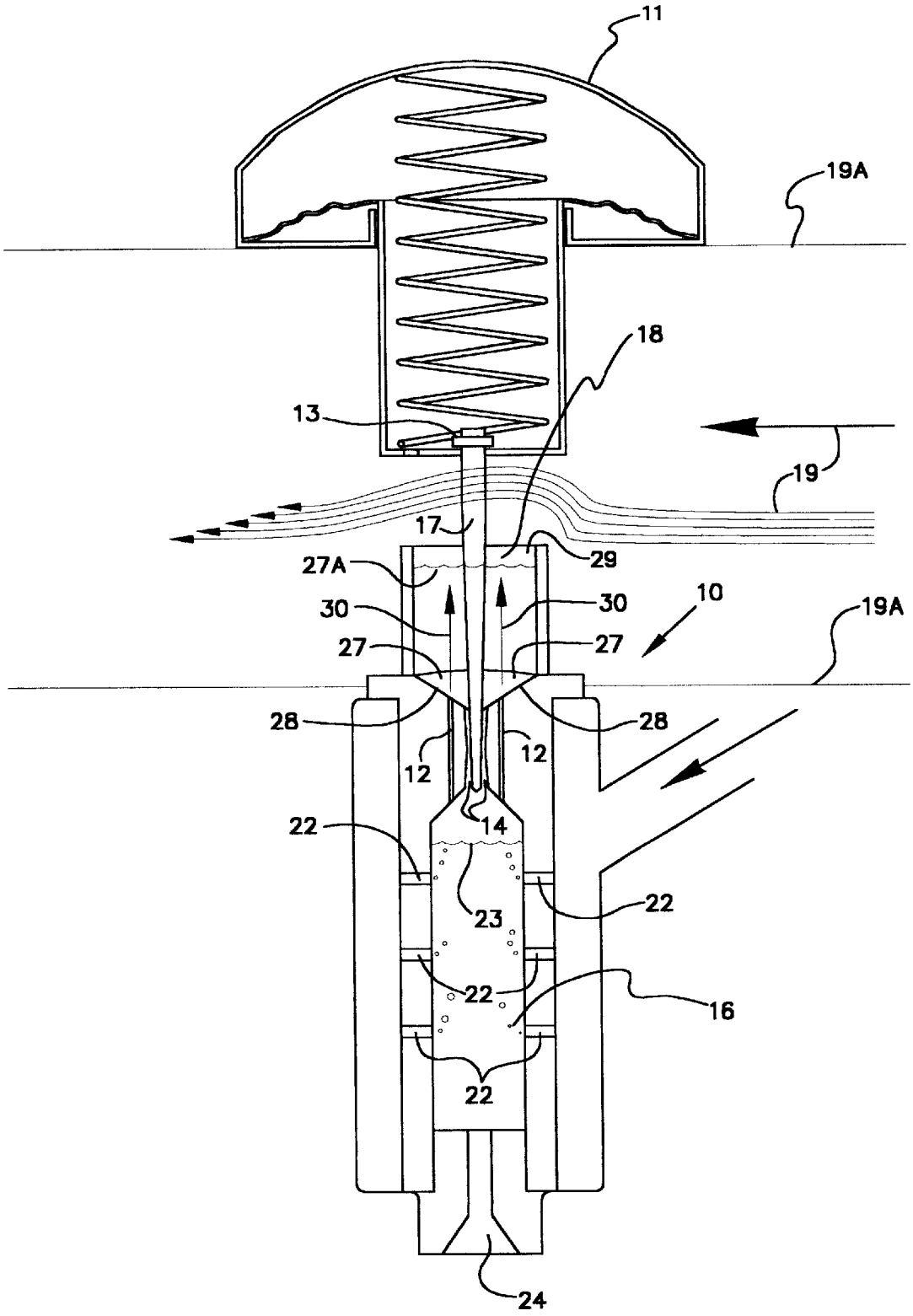
FIG. 5 is a front sectional view of the carburetor of FIG. 1 at low power demand with a fuel puddle in the outer well.
Figure 6:
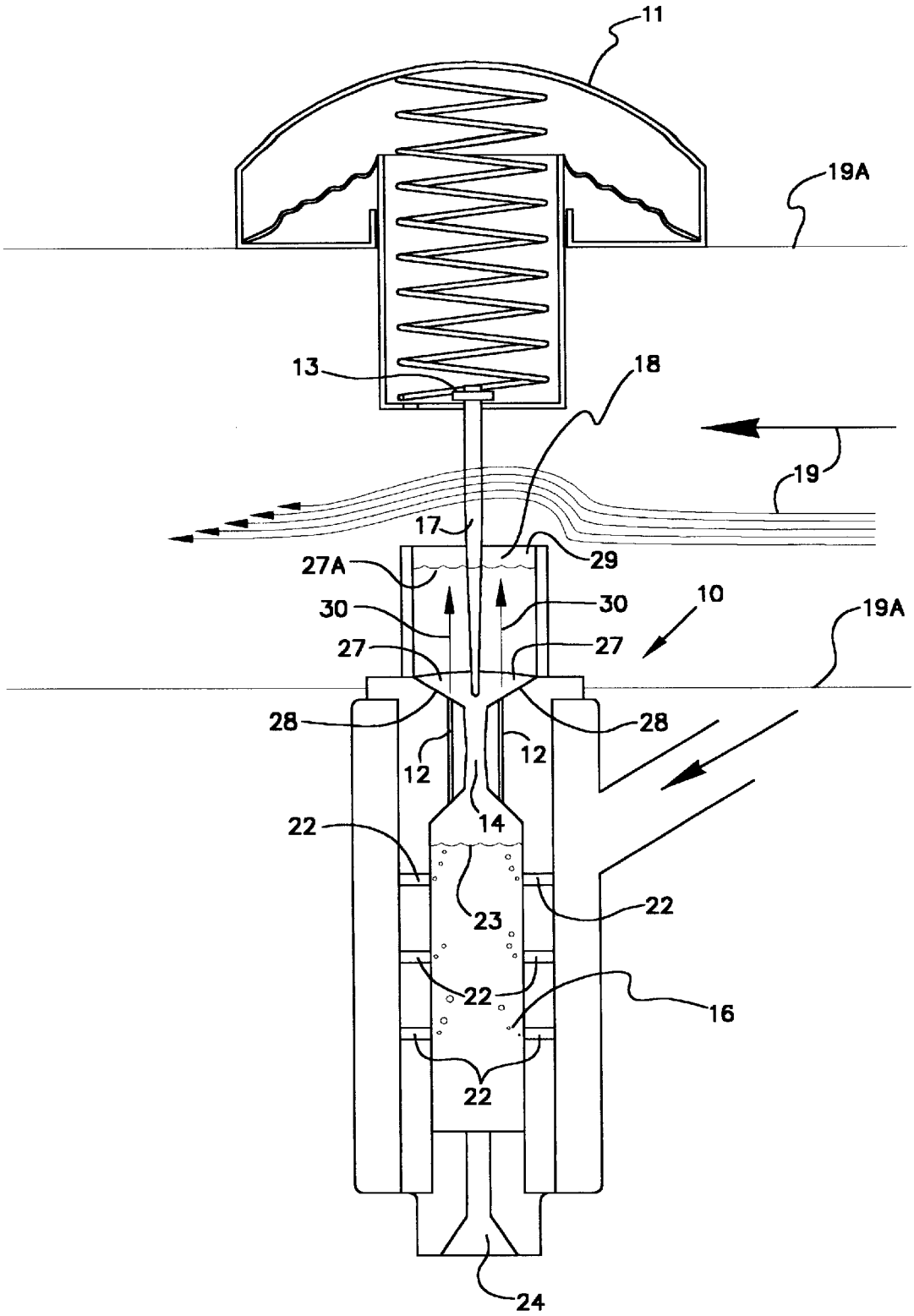
FIG. 6 is a front sectional view of the carburetor of FIG. 5 at high power demand in accordance with the present invention.
Figure 7:
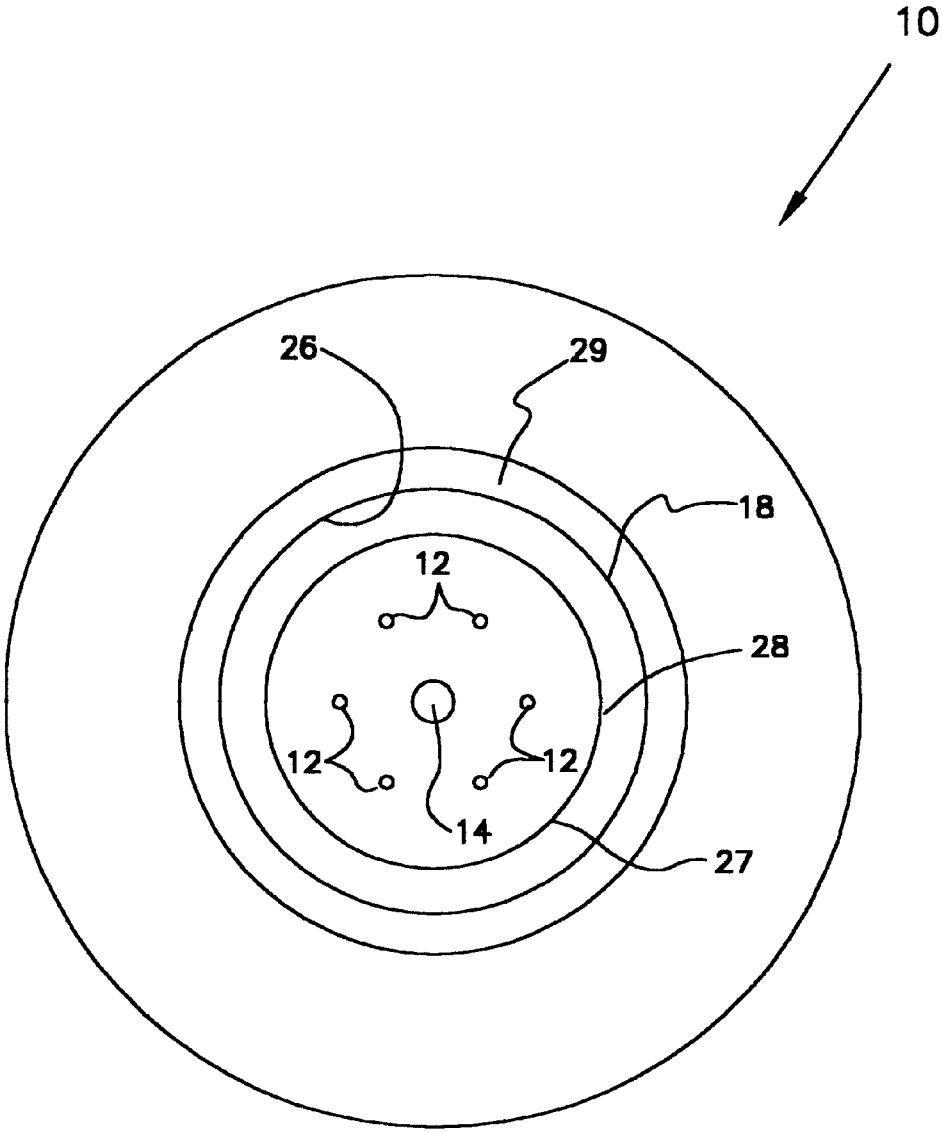
FIG. 7 is top elevation view of the carburetor of FIG. 2 with a fuel puddle in the outer well.

Referring now to FIGS. 5–7, low main air supply 19 rates through the main air passageway 19A, the air-fuel mixture through the outer well 18 forms a small but significant amount of liquid fuel that accumulates inside the outer well 18. Gravity, acting upon the liquid fuel deposited in the well 18, causes the fuel to form a growing puddle 27 in a bottom conical portion 28 of the outer well 18 that eventually fills the well 18 to a liquid level 27 A as depicted in FIGS. 4 and 5. As long as the needle 17 remains partially inside the orifice 14, a position corresponding to a low power demand on the engine, a limited amount of air-gas flow occurs resulting in the fuel puddle 27 remaining below the top of the outer well 18 which does not affect engine operation even with the air-gas flow passing through the puddle 27.

However, in prior art carburetor's, when the throttle is quickly positioned at maximum demand, the needle 17 is forced to a maximum removed position from the orifice 14 thereby causing a maximum vacuum pressure and a corresponding maximum air-fuel flow through the orifice 14. The liquid fuel in the outer well 18 is dispersed into large droplets (not shown) and lifted out the outer well 18 by the maximum air fuel flow rate generated by the low pressure of the venturi action from the main air flow. The large droplets are burned in the cylinders 25 of the internal combustion engine. The large droplets bum inefficiently and incompletely causing an increase in unburned hydrocarbon emissions and a decrease in engine response to throttle demand. The improved motorcycle carburetor 10 prevents the large droplets through the utilization of the apertures 12 around the orifice 14.

The apertures 12 are positioned in an equally spaced relationship circumferentially around the orifice 14 such that the longitudinal axis of the apertures 12 are parallel with the longitudinal axis of the orifice 14. The apertures 12 have relatively small cross sectional areas and are dimensioned to utilize the frictional forces of the liquid fuel to prevent the puddle 27 and 27A of liquid fuel from draining through the apertures 12 and into the cavity 16 irrespective of the quantity of fuel in the well 18 that accumulates during low power operation of the engine. Further, when covered with liquid fuel at low power operation, the relatively small cross sectional areas of the apertures 12 discourage an air-fuel flow from passing from the cavity 16 and into the outer well 18 via the apertures 12.

When the engine is transformed from a low power to a high power level of operation, the generated vacuum pressures and air-fuel rates resulting therefrom are sufficient to force air-fuel flows 30 through the apertures 12 and into the liquid fuel puddle 27 thereby lifting and "breaking up" or evaporating the puddle 27 into a fine mist, thus promoting a more complete combustion, decreasing hydrocarbon emissions, and improving power output, brake fuel specifics and throttle response.

The apertures 12 relative positioning around the orifice 14, the cross-sectional areas of the apertures 12 and the quantity of apertures 12 utilized to evaporate the puddles 27 and 27A varies with the carburetor manufactures and type of fuel supplying the internal combustion engine. For each selected carburetor, the aperture 12 parameters must be empirically determined. For example, a thirty-six millimeter MIKUNI constant velocity carburetor requires six equally spaces apertures 12 circumferentially positioned around the orifice 14 such that the radial distance between the orifice 14 and any one aperture 12, is one-half the radial distance between the inner wall 26 of the outer well 18 and any one aperture 12. Also, the cross-sectional area of each of the six apertures corresponds to a diameter dimensioned to be substantially about 0.013 inches.

The foregoing description is for purpose of illustration only and is not intended to limit the scope of protection accorded this invention. The scope of protection is to be measured by the following claims, which should be interpreted as broadly as the inventive contribution permits.

What is claimed is:

1. An improved carburetor device for an internal combustion engine, said improvement comprising:

a plurality of apertures circumferentially disposed in relation to an orifice joining an inner mixing cavity to an outer well member, the orifice having an air flow control member inserted therein, said apertures extending from the inner mixing cavity to the outer well member;

means for preventing liquid fuel from draining into said apertures;

means for urging air flow through said apertures; and means for engaging said liquid fuel with said air flow through said apertures thereby vaporizing said liquid fuel and correspondingly increasing power output and decreasing unburned hydrocarbon emissions from the internal combustion engine.

2. The device of claim 1 wherein said apertures are positioned such that the longitudinal axes of said apertures are parallel to the central axis of the orifice.

3. The device of claim 1 wherein said liquid fuel flow prevention means includes dimensioning said apertures such that said apertures are substantially about 0.013 inches in diameter.

4. The device of claim 1 wherein said air flow urging means includes opening a throttle member of the carburetor to a maximum open position.

5. The device of claim 1 wherein said means for engaging said liquid fuel with said air flow includes positioning said apertures adjacently to the orifice such that said liquid fuel engages said apertures when said liquid fuel drains into a funnel configured bottom portion of the outer well member of the carburetor.

6. A method of improving liquid fuel vaporization in a carburetor comprising the steps of:

A. providing a plurality of apertures circunferentially disposed around an orifice joining an inner mixing cavity to an outer well member of the carburetor, said apertures extending from the inner mixing cavity to the outer well member;

B. preventing liquid fuel from draining into said apertures;

C. urging air flow through said apertures when a throttle member of the internal combustion engine, is set to a predetermined mixed position; and D. engaging said liquid fuel with said air flow through said apertures.

7. The method of claim 6 wherein said plurality of apertures are positioned such that the longitudinal axis of said apertures are parallel to the central axis of the orifice.

8. The method of claim 6 wherein the step of preventing liquid fuel flow includes the step of dimensioning the diameters of said apertures to be substantially about 0.013 inches.

9. The method of claim 6 wherein the step of urging air flow through said apertures includes positioning the throttle member of the internal combustion engine to a maximum open position.

10. The method of claim 6 wherein the step of engaging said liquid fuel with said air flow through said apertures includes the step of positioning said apertures adjacently to the orifice such that said liquid fuel engages said apertures when said liquid fuel drains into a funnel configured bottom portion of the outer well member of the carburetor.

11. A method of maintaining the fuel-air mixture ratio from a carburetor to an internal combustion engine during increasing vacuum pressure, comprising the steps of:

A. providing a plurality of apertures circumferentially disposed around a carburetor orifice joining an air-fuel mixing cavity to a well member, said apertures extending from the mixing cavity to the well member:

B. selecting apertures having a cross sectional area that prevents liquid fuel drainage, and allows air flow therethrough upon a predetermined engine vacuum pressure being attained; and C. engaging said liquid fuel with said aperture air flow.

12. The method of claim 11 wherein said plurality of apertures are positioned such that the longitudinal axis of said apertures are parallel to the central axis of the carburetor orifice.

13. The method of claim 11 wherein the step of preventing liquid fuel drainage and allowing air flow includes the step of dimensioning the diameters of said apertures to be substantially about 0.013 inches.

14. The method of claim 11 wherein the step of engaging said liquid fuel with said aperture air flow includes the step of disposing said aperture adjacently to the carburetor orifice such that said liquid fuel engages said apertures when said liquid fuel deposits into a funnel configured bottom portion of the well member of the carburetor.

* * * * *